United States Patent [19]

Dalle et al.

[11] Patent Number: 4,908,156

[45] Date of Patent: Mar. 13, 1990

[54] SELF-REGULATING HEATING ELEMENT AND A PROCESS FOR THE PRODUCTION THEREOF

[75] Inventors: Bernard M. Dalle, Palaiseau; Claude Caillot; Francois A. Legros, both of Paris, all of France

[73] Assignee: Electricite de France (Service National), Paris, France

[21] Appl. No.: 87,323

[22] Filed: Aug. 20, 1987

[30] Foreign Application Priority Data

Aug. 21, 1986 [FR] France ..... 86 11945

[51] Int. Cl.[4] ..... H01B 1/06

[52] U.S. Cl. ..... 252/511; 219/549; 219/553; 338/22 SD; 524/495; 524/496

[58] Field of Search ..... 252/511; 524/495, 496; 219/543, 548, 549; 338/22 SD

[56] References Cited

U.S. PATENT DOCUMENTS 4,150,193 4/1979 Burns ..... 252/511
4,388,607 6/1983 Toy et al. ..... 252/511
4,629,869 12/1986 Bronval ..... 219/553
4,696,765 9/1987 Kakizaki et al. ..... 524/495

FOREIGN PATENT DOCUMENTS 0008235 2/1980 European Pat. Off. .
2200590 4/1974 France .
2374357 7/1978 France .

*Primary Examiner*—Josephine Barr
*Attorney, Agent, or Firm*—Fleit, Jacobson, Cohn, Price, Holman & Stern

[57] ABSTRACT

A self-regulating heating element (1) comprising a crosslinked copolymer based on ethylene and a comonomer of vinyl acetate in which the proportion of vinyl acetate is less than 10% and more than 2% by weight, more especially from 9 to 2% by weight and, in practice, from 9 to 5% by weight, said copolymer containing from 13 to 30% by weight carbon black and having a ratio $$\frac{\rho_{max}}{\rho_{amb}}$$

of greater than $10^4$.

3 Claims, 1 Drawing Sheet

SELF-REGULATING HEATING ELEMENT AND A PROCESS FOR THE PRODUCTION THEREOF

Figure 1:
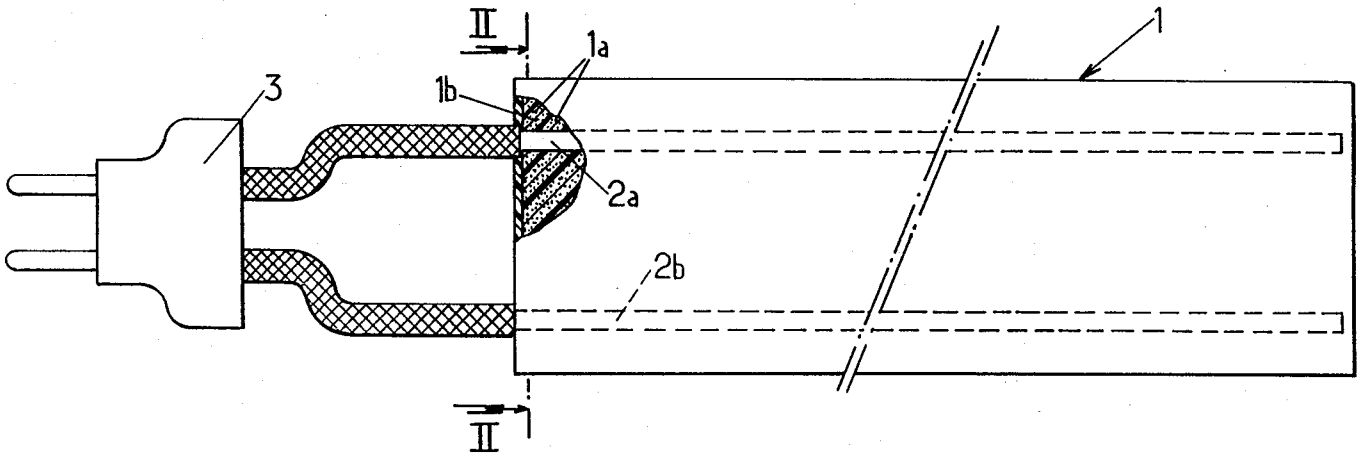

This invention relates to a self-regulating heating element.

The invention also relates to a process for the production of said element.

It is known that self-regulating heating elements are structures, more especially of the cable or band type, made of a synthetic polymeric material to which a resistivity increasing from ambient temperature (when it has a value termined $\rho$amb) to a temperature known as the "switching temperature", from which it increases very rapidly to a maximum value termed $\rho$max, is imparted through the incorporation of conductive charges, more especially of carbon black.

The self-regulating heating elements in question are said to have a positive temperature coefficient (PTC for short).

In practice, the switching temperature is not very far from the melting temperature for the polymer and experience has shown that, at temperatures above their melting temperature, certain polymers have a negative temperature coefficient (NTC for short), corresponding to a rapid reduction in resistivity.

It is known that the NTC can be eliminated by crosslinking of the polymer.

The properties of the self-regulating heating elements emanate from the PTC and the switching temperature.

Thus, by applying a given voltage, for example mains voltage, to two points of an element of the type in question, the calorific energy dissipated by Joule effect in the element will depend on the temperature at which the element is situated and, in any event, will decrease as that temperature increases; this reduction becomes more rapid when the switching temperature is exceeded.

This behavior is utilized in the applications of the self-regulating heating elements which are known to include, for example, the application in which the elements in question are used in the cladding of pipes and pipelines which have to be kept at a certain temperature and the application in which said elements are used for articles of the heated blanket type. In the cladding of pipelines for example, the self-regulating heating element keeps the "clad" pipelines at a constant temperature.

This is because, by application of the voltage mentioned above, the temperature of the heating element increases by Joule effect to a temperature beyond which little electric current flows through the element; as a result, it cools down, its resistivity decreases, more current flows, the temperature rises again and so on.

It is thus clearly apparent that, for a given application requiring the maintenance of a given temperature, it is important to have a self-regulating heating element with a given switching temperature.

Now that these generalities have been discussed, it is pointed out that the present invention relates in particular to self-regulating heating elements based on copolymers having a melting temperature $Tm_1$ obtained from an olefin, more especially ethylene, and a comonomer consisting of vinyl acetate, said copolymers comprising conductive charges formed in particular by carbon black, the heating elements in question being prepared in accordance with the prior art by a multi-step process essentially comprising:

forming an intimate mixture of the copolymer and the conductive charge.

forming, in particular by extrusion, the conductive element of the cable or band type with introduction during extrusion of the two parallel metal wires intended to be connected to the voltage source.

encasing said element in a second polymer having a melting temperature $Tm_2$ higher than $Tm_1$, annealing at a temperature $T_R$ between $Tm_1$ and $Tm_2$ and crosslinking the element, in particular by irradiation.

Elements of this kind based on ethylene and vinyl acetate are described in French patent no. 77 37496 and contain at least 10% vinyl acetate.

The major disadvantage by which they are attended is that the switching temperature is not well defined.

In other words, the resistivity of the elements in question does not increase suddenly beyond a given temperature: it simply increases more quickly beyond a certain temperature range including the switching temperature.

It is this disadvantage which the inventors set out to remedy.

As a result of intensive research, the inventors found that it was possible to impart a more clearly defined switching temperature to self-regulating heating elements of the type in question, beyond wich their resistivity increases so rapidly (this increase is of the order of $10^{=}-10^{3}$ Ω-cm for an interval of temperature of 30° C.) that hardly any more current flows in the element, providing the proportion of vinyl acetate in the constituent copolymer of said elements is reduced below 10%.

It follows that the self-regulating element according to the invention comprises a crosslinked copolymer based on ethylene and vinyl acetate in which the proportion of vinyl acetate is below 10% and above 2% by weight, more especially from 9 to 2% by weight and, in practice, from 9 to 5% by weight, said copolymer comprising from 13 to 30% by weight of carbon black selected from those of which the specific surface is from 40 to 270,
the structure index is from 100 to 270,
the volatile content is below 2%,
the mean particle size is from 10 to 40 nm.

The process according to the invention for the production of said self-regulating heating element is characterized in that it comprises the following successive steps:

preparing an ethylene/vinyl acetate copolymer containing less than 10% and more than 2% by weight vinyl acetate, mixing said copolymer with 13 to 30% of carbon black selected from those of which
the specific surface is from 40 to 270,
the structure index is from 100 to 270,
the volatile content is below 2%,
the mean particle size is from 10 to 40 nm, extruding the copolymer thus charged with carbon black, more especially in the form of a ribbon or cable, with longitudinal introduction of two parallel metal wires embedded in the copolymer, crosslinking the copolymer, more especially by irradiation.

Figure 2:
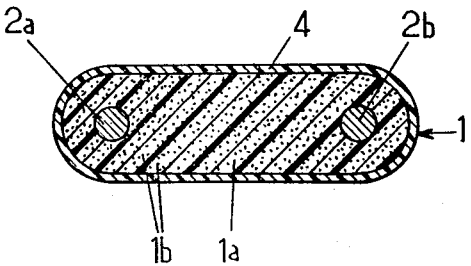

Further embodiments of the invention, which are preferably applied at the same time, are discussed in more detail hereinafter with reference to the accompanying drawings which show two advantageous embodiments of the invention and in which:

FIGS. 1 and 2 are respectively a plan view of and a section on the line II—II in FIG. 1 through a heating element according to the invention.

Accordingly, to make a self-regulating heating element of the type in question, the following procedure or an equivalent procedure is adopted in accordance with the invention.

First, a copolymer of ethylene and vinyl acetate containing less than 10% and more than 2% by weight vinyl acetate is prepared in known manner. The proportion of vinyl acetate is preferably from 9 to 2% and, in practice, from 9 to 5%.

In a single-screw mixer, for example of the type marketed by the Buss company under the trademark Ko-Malaxeur PR 46, the copolymer mentioned above and 13 to 30% by weight of carbon black selected from those of which the specific surface is from 40 to 270,
the structure index is from 100 to 270,
the volatile content is less than 2%,
the mean particle size is from 10 to 40 nm, remembering that the specific surface, which is measured by nitrogen absorption, is expressed in $m^2/g$ and provides information on the microporosity and on the size of the basic aggregate of the carbon black,
the structure index, which is measured by absorption of dibutylphthalate, is expressed in $cm^3/100$ g and provides information on the number of elementary particles in the aggregate and on the shape thereof,
the volatile content, expressed in %, shows the surface chemistry and provides information on the chemisorption and the formation of complexes at the surface of the aggregate, are thoroughly mixed for 2.5 hours at a temperature of 110° to 130° C.

Experience has shown that the increase in the specific surface and the structure index is accompanied by a decrease in resistivity whereas any increase in the volatile content is accompanied by an increase in resistivity.

The selection criteria mentioned above dictate the choice from among the carbon blacks commercially available at the present time of, for example, those which are marketed under the following trademarks:

VULCAN P (marketed by the Cabot company)
VULCAN XC 72 (marketed by the Cabot company).

The proportion in which these carbon blacks are dispersed in the copolymer is preferably from 23 to 27% by weight and more preferably 25% by weight.

It can also be useful to incorporate other additives in the mixture in question, particularly to stabilize the compositions against oxidation.

One example of a suitable anti-oxidant is the 4,4'-thio-bis-(6-tert.-butyl-3-methylphenol) marketed under the trademark SANTONOX.

The intimate mixture obtained is extruded in known manner in the form of a cable or ribbon in which two conductive wires, for example of copper, tin-plated copper or nickel-plated copper, are longitudinally embedded substantially parallel to one another.

In FIGS. 1 and 2, the ribbon is shown globally at 1 and the wires 2*a* and 2*b*.

As shown, the two wires are connected to the terminals of a source of electricity 3.

The constituent copolymer 1*a* of the ribbon, once extruded and provided with its wire, is crosslinked by irradiation; the conductive charges distributed in the copolymer are shown at 1*b*.

The radiation may be applied by electron bombardment ($\beta$-radiation) in a dose of 15 Mrads.

It can be of advantage to encase the ribbon 1 in a sheath 4 of a polymer or mixture of polymers of which the melting temperature is higher than that of the ribbon 1 which is 105° C., 102° C. and 98° C. for vinyl acetate contents of 5%, 7.5% and 9%, respectively.

The switching temperature Ts [which corresponds to the intersection of the segments (quasi-linear for the copolymers used in accordance with the invention) on the ascending part of the curve $$\text{Log } p = f(T)$$

(the first segment being that comprised between the ambient temperature and the switching temperature while the second is that showing the increase—sudden in the case of the copolymers used in accordance with the invention—in resistivity above the switching temperature)] is determined with an inaccuracy of only ±5° C.

Since the temperatures Ts measured for the copolymers containing 5, 7.5 and 9% vinyl acetate are respectively 75° C., 72° C. and 66° C., the range in which the switching temperatures of copolymers containing from 5 to 9% vinyl acetate are situated is from 61° to 80° C.

At ambient temperature and for a carbon black content of approximately 25%, the elements according to the invention have a resistivity of $10^4$ to $10^5$ Ω-cm which is reflected in the fact that the inequality $2\times$(carbon black concentration)$+5 \log p \geqq 70$ is satisfied.

Since the resistivity value $\rho max$ (expressed in Ω-cm) at the peak temperature is approximately $10^9$ whereas it is $5.10^4$ at ambient temperature in the case of the element according to the invention formed by a copolymer comprising 9% by weight vinyl acetate in which 25% by weight carbon black has been dispersed, the ratio $$\frac{\rho max}{\rho amb}$$

is approximately $2.10^4$.

More generally, this ratio is above $10^4$ for all the heating elements of the type in question according to the invention, which shows the clear and sudden character of the increase in resistivity beyond the switching temperature, character which known heating elements of the type in question do not have.

In addition, the stability of the self-regulating heating elements according to the invention is remarkable, the reduction in the peak ratio being very slight after 100 cycles between 70° and 130° C.

By virtue of the crosslinking of the copolymer, the heating elements according to the invention do not have a negative temperature coefficient between the melting temperature of the copolymer and 120° C.

Finally, the constituent copolymer of the self-regulating heating elements according to the invention does not flow in accordance with the Standard NFC 32020.

For the sake of completeness, it is pointed out that if proportions of vinyl acetate in the copolymer below 5% are not used in practice although such small proportions would be advantageous from the point of view of the increase in $$\frac{\rho_{max}}{\rho_{amb}}$$

it is because the crystallinity of the copolymer increases in that case to such an extent that the mechanical properties of the element are adversely affected.

Irrespective of the embodiment adopted, the invention thus provides a self-regulating heating element of which the characteristics are sufficiently apparent from the foregoing that it is unnecessary to discuss them further and which have numerous advantages over existing heating elements of the type in question, more especially a particularly welldefined switching temperature.

Naturally and as already apparent from the foregoing, the invention is by no means limited to those embodiments and applications which have been particularly envisaged. On the contrary, it encompasses all the variants.

We claim:

1. In a self-regulating heating element of the cable or band type of a crosslinked synthetic polymeric material based on ethylene and vinyl acetate to which a resistivity $\rho$, increasing with the temperature from a value $\rho$amb at ambient temperature to a maximum value $\rho$max, is imparted by incorporating conductive charges consisting of carbon black, the improvement according to which the proportion of vinyl acetate is from 9 to 2% by weight, said carbon black which is present in a proportion from 13 to 30% by weight being selected from those of which the specific surface is from 40 to 270,
the structure index is from 100 to 270,
the volatile content is less than 2%,
the mean particle size is from 10 to 40 nm.

2. A self-regulating heating element according to claim 1, wherein the proportion of vinyl acetate in the cross-linked polymer is from 9 to 5% by weight.

3. A self-regulating heating element according to claim 1, wherein $\rho$amb and $\rho$max are such that their ratio $$\frac{\rho_{max}}{\rho_{amb}}$$

is greater than $10^4$.

* * * * *